United States Patent [19]

Klein

[11] Patent Number: 4,856,206

[45] Date of Patent: Aug. 15, 1989

[54] DRYING CENTER

[76] Inventor: Robert Klein, 1112 Park Ave., Apartment 5C, New York, N.Y. 10028

[21] Appl. No.: 121,934

[22] Filed: Nov. 18, 1987

[51] Int. Cl.[4] ..... F26B 13/00

[52] U.S. Cl. ..... 34/151; 34/239; 34/91; 219/386

[58] Field of Search ..... 34/96, 97, 151, 90, 34/91, 239; 219/386

[56] References Cited

U.S. PATENT DOCUMENTS

| | | | |
|---|---|---|---|
| 906,153 | 12/1908 | Von Ohlen . | |
| 2,045,890 | 6/1936 | Uhalt et al. . | |
| 2,239,808 | 4/1941 | Bostick . | |
| 2,325,478 | 7/1943 | Collins . | |
| 2,355,835 | 8/1944 | Whalen . | |
| 2,469,298 | 5/1949 | Gilmore, Jr. . | |
| 2,479,887 | 8/1949 | Wolcott . | |
| 3,126,099 | 3/1964 | Powell . | |
| 3,157,475 | 11/1964 | Stainbrook | 34/90 |
| 3,190,012 | 6/1965 | Gray | 34/91 X |
| 3,421,614 | 1/1969 | Crane . | |
| 3,441,112 | 4/1969 | Maben . | |
| 3,641,947 | 2/1972 | Finney . | |
| 3,941,250 | 3/1976 | Ott . | |

FOREIGN PATENT DOCUMENTS

| | | | |
|---|---|---|---|
| 1525253 | 12/1967 | France | 34/151 |
| 94819 | 8/1959 | Norway | 34/91 |

*Primary Examiner*—Henry A. Bennet

*Attorney, Agent, or Firm*—Amster, Rothstein & Ebenstein

[57] ABSTRACT

A drying center comprises a cabinet and a drop board pivotally secured to the cabinet and movable between a dropped position wherein the board is substantially horizontal and a raised position wherein the board is substantially vertical. The drop board defines a plenum and in the dropped position has an upper surface defining a plurality of spaced apertures in gaseous communication with the plenum. The center further includes an air source for blowing dry air, a connector for selectively operatively connecting and disconnecting the air source and the plenum, and supports normally disposed within the cabinet for supporting objects to be dried over the apertures when the board is in the dropped position.

41 Claims, 7 Drawing Sheets

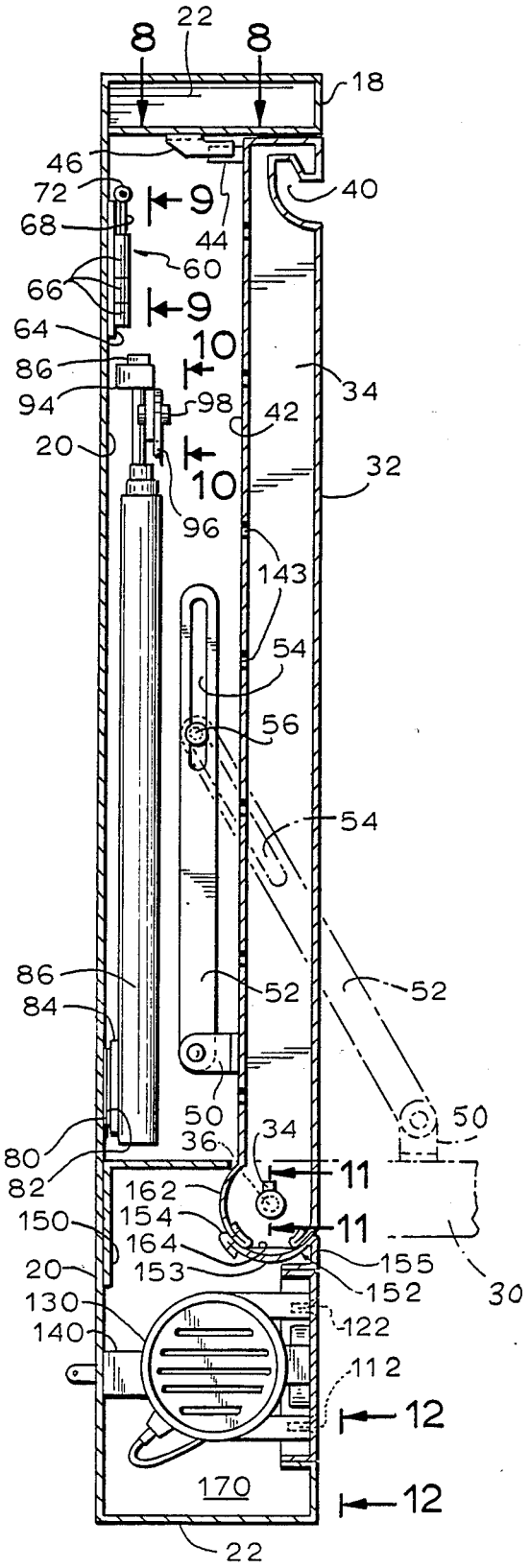
FIG. 4
FIG. 8
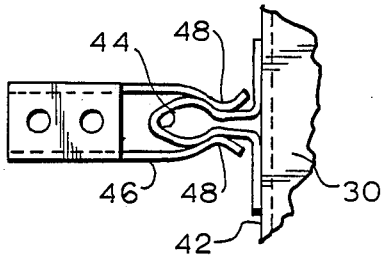
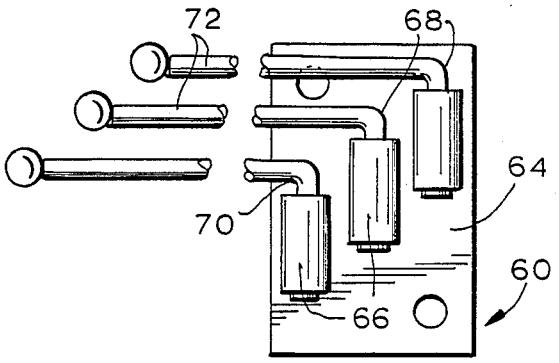
FIG. 9

FIG. 10
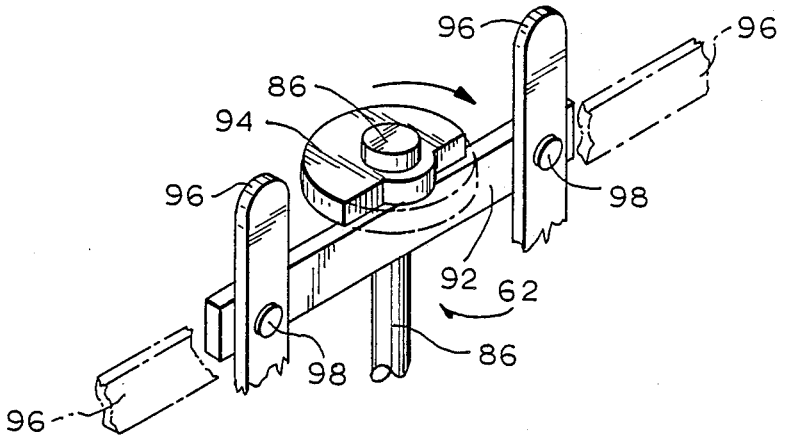
FIG. 11
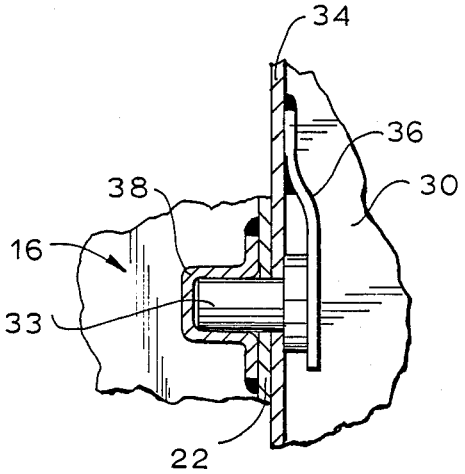
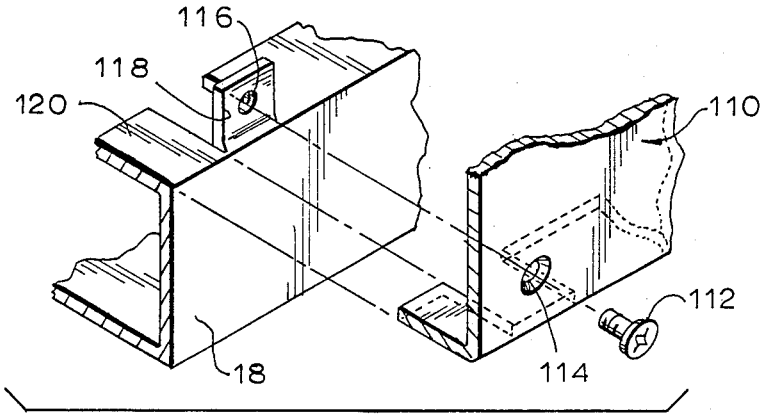
FIG. 12

DRYING CENTER

BACKGROUND OF THE INVENTION

The present invention relates to devices for drying things and, more particularly, to a device for drying things by blowing dry air thereon.

Wet articles such as bathing suits, recently washed clothing, used towels and the like can be conveniently, albeit not rapidly, dried simply by hanging the articles over a convenient catch basin for the moisture such as a sink or tub. Drying of the article may be accelerated first by wring drying it (if the article can be wrung and there is no objection to wrinkles therein) or, towel drying it (if a dry towel is available and there is no objection to lint being transferred to the article from the towel). The preferred technique by far is to cause a stream of dry air to impinge upon the article and/or pass therethrough. Theoretically this could be accomplished by moving the article at a rapid rate around a dry room, but this is somewhat impractical. Alternatively, a stream of dry air may be directed at and/or through a stationary article, but this requires a dry air source, such as a dry air blower, and convenient places to hang the blower and the articles to be dried so that they are in appropriate relationship—that is, the dry air stream impinges upon the article.

When one is away from one's own bathroom, one typically impresses into duty a conventional hair blower, provided one has had the foresight to bring one and provided there are appropriate means for mounting the blower and the articles to be dried in appropriate juxtaposition to each other and to the electrical socket. It will be appreciated that the conventional hair blower may be set to provide either a stream of cool, presumably dry air or heated air. The latter is preferred for many drying purposes because room temperature air and hot air have different drying capabilities, the hot air being capable of removing and holding a greater amount of moisture and thus exerting a greater drying effect than the room temperature air. Unfortunately, hot air blowers tend to be bulky and frequently a traveler or visitor will not carry one in his baggage. Indeed, some of the top world class luxury hotels have commenced to supply portable hair blowers to their guests as part of the bathroom amenities.

Even so, hair blowers are designed for hair blowing and not for drying other articles such as towels, clothing, bathing suits and the like. Such articles require a sustained stream of hot air provided over a relatively large area, for example, so that several articles of clothing may be dried at once. However conventional portable hair blowers typically include a protective shut-off switch which deactivates the blower when it overheats from prolonged use; such blowers cannot provide the prolonged stream required to dry large articles of clothing. Conventional portable hair blowers typically produce a hot air stream of relatively small cross sectional area; such a blower would obviously be ineffective in drying large articles of clothing or a large number of small articles of clothing.

Thus the need remains for a drying device which can produce a prolonged hot air stream of substantial cross sectional area in a hotel room, bathroom, guest bathroom, beach cabana, or the like. When it is not in use, the drying device must be of compact orientation so that it does not occupy valuable space unnecessarily. Preferably the device should be capable of being secured to the room in which it is to be used so as to prevent removal therefrom by intentionally or unintentionally acquisitive guests.

Accordingly, it is an object of the present invention to provide a drying device which is capable of providing a prolonged stream of dry air of a substantial cross section.

Another object is to provide such a device which provides a dry air stream of hot air.

A further object is to provide such a device which has a compact orientation when not in use.

It is also an object to provide such a device which includes means for supporting the articles to be dried in the dry air stream.

It is another object to provide such a device which in one embodiment can be fixedly secured to a wall.

It is yet another object to provide such a device which in one embodiment can be used to dry clothing or hair.

It is a further object to provide such a device which is of hardy, rugged and economical construction, easy and economical to use and maintain.

It has now been found that the above and related objects of the present invention are obtained in a drying center comprising a cabinet and a drop board secured to the cabinet and movable between a dropped position wherein the board is substantially horizontal and a raised position wherein the board is substantially vertical. The drop board defines a plenum and in the dropped position has a upper surface defining a plurality of spaced apertures in gaseous communication with the plenum. Means are provided for operatively connecting the plenum and an air source for blowing air.

The drop board is preferably pivotally mounted at one end in the cabinet, the drying center additionally comprising means limiting movement of the drop board from the raised position beyond the dropped position. The drop board in the raised position typically comprises at least a portion of the cabinet front wall. The plenum is substantially coextensive with the plurality of apertures, and the connecting means operatively connects the air source and the plenum (and hence the apertures) when the drop board is in the dropped position and disconnects the same when the drop board is in the raised position. The air source is a source of heated dry air.

Support means, normally disposed within the cabinet, are provided for supporting objects to be dried over the apertures when the board is in the dropped position. The support means is movable between a withdrawn position totally within the cabinet and an extended position extending at least partially out o the cabinet.

The drying center preferably additionally comprising a normally closed port in gaseous communication with the air source, the port being adapted to provide gaseous communication between the air source and an air driven external drying device such as a hair dryer cap.

The drying center may be used in combination with a room having a wall, the cabinet optionally being flush mounted on the wall, with the wall of the room and the front wall of said cabinet being flush. Alternatively, the drying center may be portable and additionally include means secured to the cabinet for carrying the drying center.

In a preferred embodiment the drying center comprises a housing and plenum means defining a plenum and having a surface defining a plurality of spaced apertures in gaseous communication with the plenum. Mounting mean mount the plenum means on the housing for movement between an operative position wherein at least some of the plurality of spaced apertures are substantially spaced from the housing and a storage position wherein the plenum means acts as a closure for the housing. Connecting means operatively connect the plenum means and an air source for blowing air.

BRIEF DESCRIPTION OF THE DRAWINGS

The above brief description, as well as further objects and features of the present invention will be more fully understood by reference to the following detailed description of the presently preferred, albeit illustrative, embodiments of the present invention when taken in conjunction with the accompanying drawing wherein:

FIG. 4 is a side elevation view of the drying center, taken along the line 4—4 of FIG. 1, to a slightly enlarged scale, with the drop board being shown in the raised orientation in solid line and fragmentarily in the lowered orientation in phantom line;

FIG. 8 is a fragmentary top plan view, to a greatly enlarged scale, taken along the line 8—8 of FIG. 4, showing the mechanism for securing the drop board in the raised orientation;

FIG. 9 is a fragmentary front elevation view, taken along the line 9—9 of FIG. 4, to a greatly enlarged scale, showing in storage position the horizontally pivotable hanger fingers for supporting articles over the lowered drop board;

FIG. 10 is a fragmentary front elevation view, taken along the line 10—10 of FIG. 4, to a greatly enlarged scale, showing the vertically pivotable hanger fingers in the storage position in solid line and in the extended position in phantom line;

FIG. 11 is a fragmentary front elevation view, taken along the line 11—11 of FIG. 4, partially in cross-section and to a greatly enlarged scale, showing one of the side pivot mean for the drop board;

FIG. 12 is a fragmentary front elevation view, partially in cross section and to a greatly enlarged scale greatly enlarged scale, of the front panel mounting system;

DETAILED DESCRIPTION OF THE PREFERRED EMBODIMENTS

Figure 1:
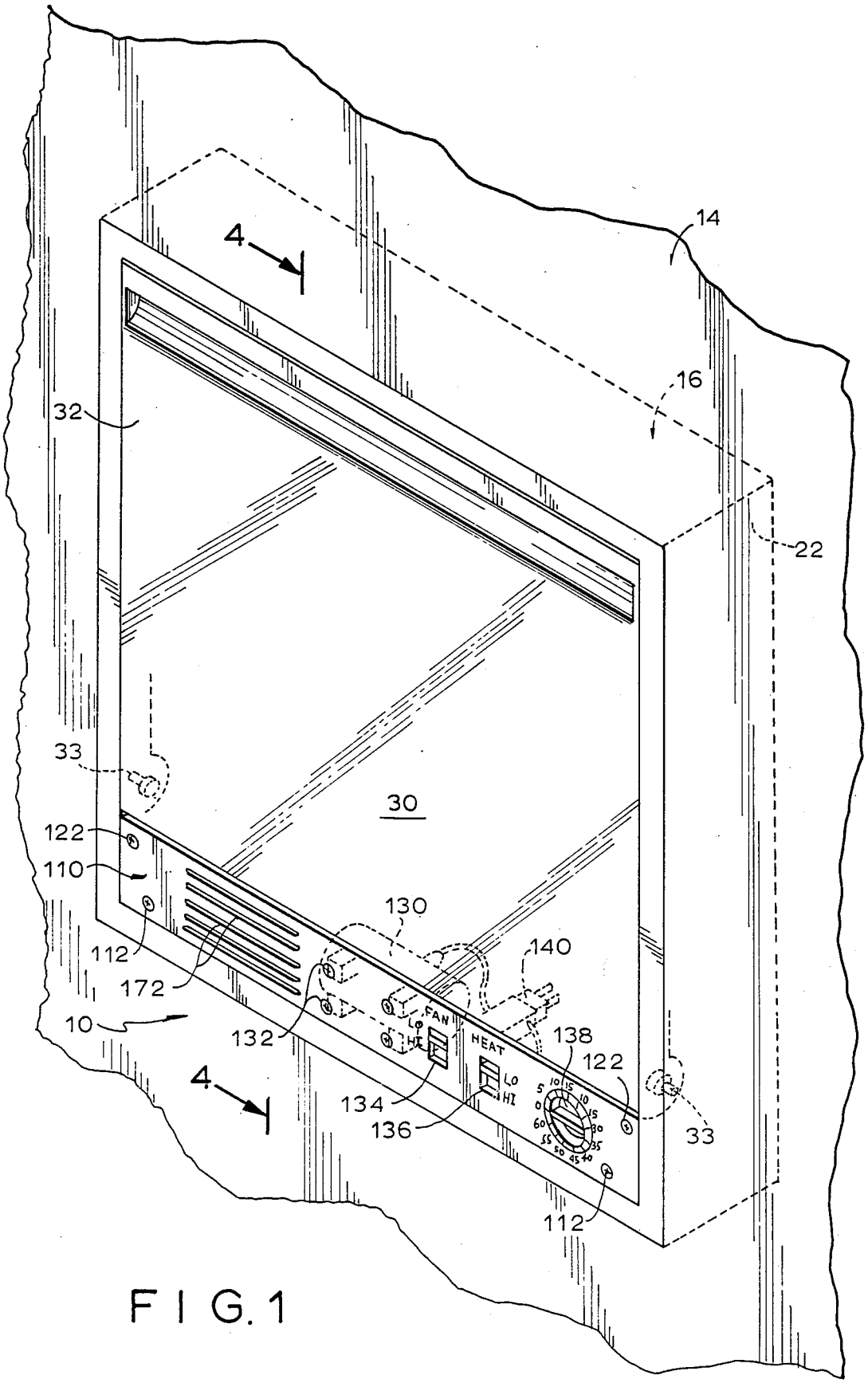
FIG. 1 is an isometric view of a first embodiment of a drying center according to the present invention, shown flush mounted in a fragmentary wall with the drop board in the raised orientation, ready for use as a mirror.
Figure 2:
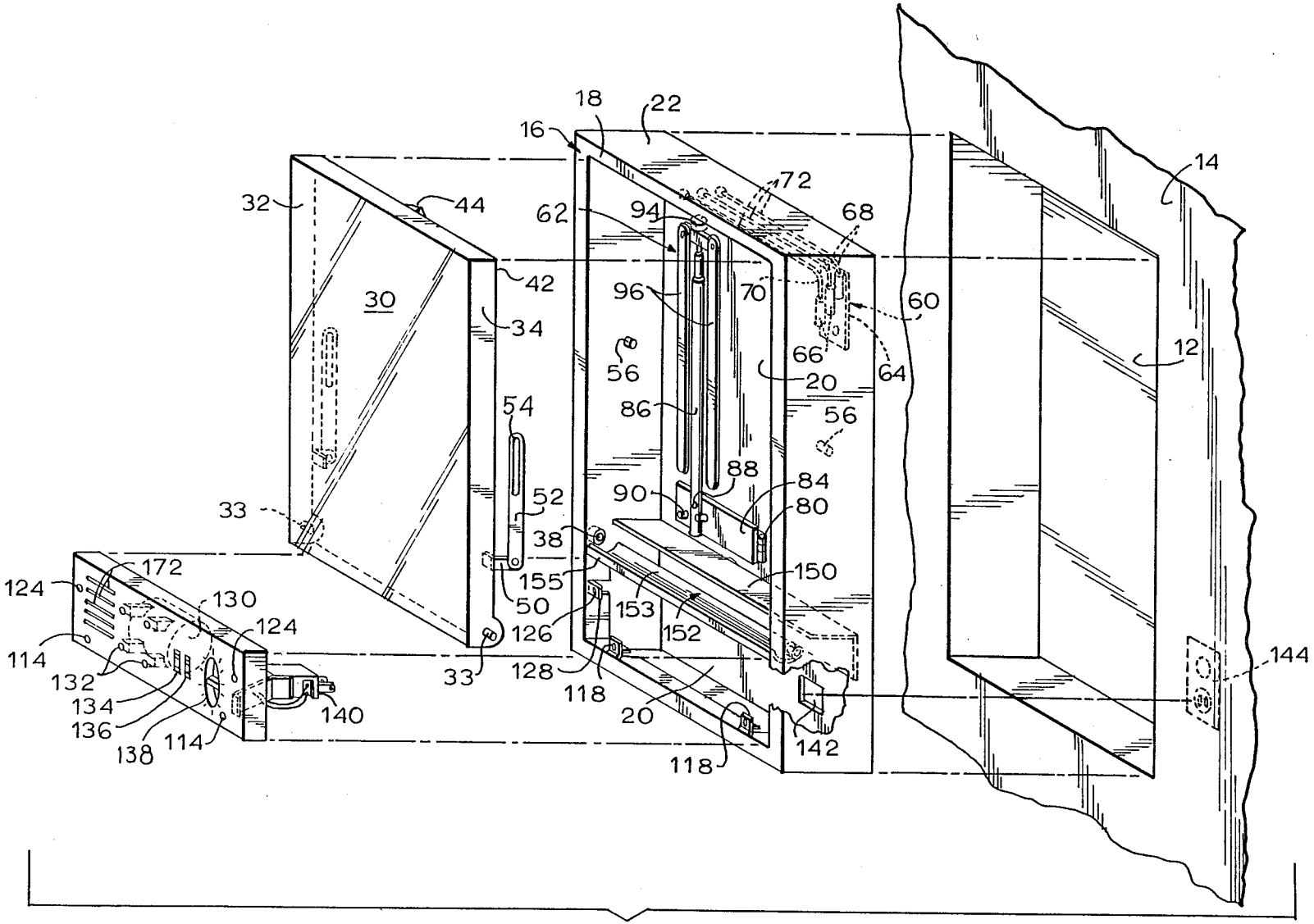
FIG. 2 is a partially exploded isometric view of the drying center and fragmentary wall of FIG. 1, to a slightly reduced scale.

Referring now to the drawing, and in particular to FIGS. 1–4 thereof, therein illustrated is a first embodiment of a drying center according to the present invention, generally designated by the reference numeral 10. As illustrated in FIGS. 1 and 2, the drying center 10 is flush mounted in the recess 12 of a wall 14 which may be the wall of a bathroom, guest room, cabana, hotel room or the like. The drying center 10 comprises a box like housing or cabinet generally designated 16 having a front wall 18 flush with the surface of room wall 14, a back wall 20 disposed against the rear of the recess 12 and a sidewall 22 snugly received within the recess 12 and connecting the front and rear walls 18, 20.

Figure 3:
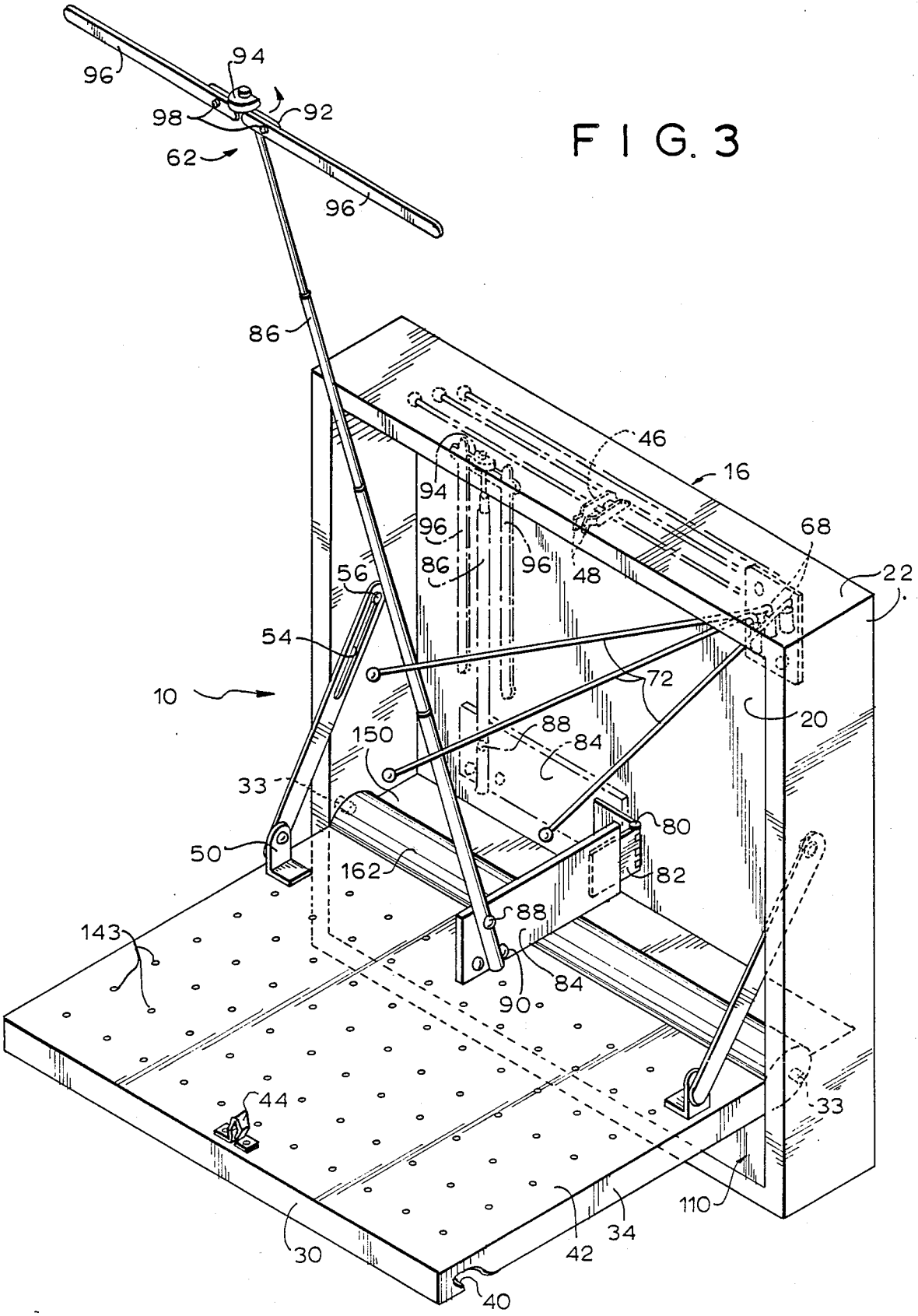
FIG. 3 is an isometric view of the drying center of FIG. 1, with the drop board in the lowered orientation and the hanger fingers in the extended position, ready for use as a drying center.

A drop board 30 is pivotally secured to the cabinet 16 and movable between a dropped or operative position (as shown in FIG. 3) wherein the board 30 is substantially horizontal and a raised or storage position (as shown in FIGS. 1, 2 and 4) wherein the board 30 is substantially vertical. In its raised position the board 30 is flush with the cabinet front wall 18 and may be considered a portion or extension thereof. The lower surface 32 of the board 30 when the board is in the dropped position constitutes the outer vertical surface of the board 30 when the board is in its raised position and may be mirrored to provide a useful reflecting surface when the board is in the raised position, thereby enabling drying center 10 to serve a useful function even when it is not in use as a drying center. Alternatively, the same surface 32 may have thereon an informative notice, a decoration, or the like. The outer wall 32 of the drop board 30 in its raised position (corresponding to the lower wall of the board 30 in its dropped position) further defines adjacent the top thereof a finger grip 40 extending across the width thereof to facilitate grasping of the upper end of the drop board 30 in its raised position so that it may be pulled outwardly and downwardly to its dropped position.

The upper surface 42 of the drop board 30 when the board is in the dropped position constitutes the inner vertical surface of the board 30 when the board is in its raised position. A matrix of small apertures 143 is disposed over the upper surface 42 of the board for reasons which will become apparent hereinafter. The matrix of apertures is preferably generally coextensive with the portion of the board upper surface 42 extending outwardly beyond the cabinet 16 when the board is in the dropped position. Thus it will be appreciated that the drop means 30 is movable between a dropped or operative position wherein at least some of the spaced apertures are substantially spaced outwardly from the cabinet 16 and a raised or storage position wherein the drop board 30 acts as a closure or face for the cabinet 16.

Referring now also to FIG. 11, the drop board 30 is pivotally connected adjacent the base thereof to the cabinet 16 on each side by means of a bearing 33 disposed in an aperture of the sidewall 34 of board 30 and springloaded outwardly by biasing lever 36 into a bushing 38 on the cabinet vertical sidewall 22. This spring-loading of the bearing 33 facilitates removal of the drop board 30 from the cabinet 16 through manual relief of biasing lever 36, as may be necessary for cleaning and the like, as well as assembly of the elements 16, 30.

Referring now also to FIG. 8, in order to maintain the drop board 30 in its raised position, the inner wall 42 of the board 30 in its raised position (corresponding to the upper wall of the board 30 in its dropped position) is provided adjacent the top thereof with a tapered nose boss 44 adapted to be removably engaged by a forwardly facing resilient catch 46 depending from the upper horizontal sidewall 22 of the cabinet 16. The catch 46 includes a pair of wings 48 resiliently biased together but spreadable by the tapered nose of the boss 44 as the board 30 is moved into its raised position, after which the bias of the winds 48 grasps the boss 44 around a reduced diameter waist portion thereof. Outward movement of the board 30 by means of finger grip 40 causes the boss 44 to resiliently spread the wings 48 until the boss 44 is removed therefrom and the board 3 is moving towards the dropped position.

In order to preclude movement of the drop board 30 below the desired horizontal dropped position, opposite sides 34 of the drop board 30 are secured to the cabinet vertical sidewalls 22 by means of angle members 50 and slot bars 52, the latter being pivotally attached at one end to the angle members 50 and at the other end by means of an elongated slot 54 to pivot pins 56 extending inwardly from the cabinet vertical sidewalls 22. When the board 30 is in its raised position (as shown in FIGS. 1, 2 and 4), the angle means 50, slot bars 52 and pivot pins 56 are disposed within the cabinet 16 and concealed from view; when the board 30 is in its dropped position (as shown in FIG. 3 and in phantom line in FIG. 4), the engagement of the pivot pin 56 within the slot 54 of the slot member 52 precludes further downward travel of the board 30 and angle member 50 beyond the dropped position. As the board 30 moves from its raised position to its dropped position the pivot pin 56 moves within slot 54 from a position adjacent the bottom thereof to a position abutting the top thereof.

Referring now to FIGS. 9 and 10 as well, the drying center 10 additionally comprises both horizontally pivotable means, generally designated 60, for supporting articles and vertically pivotable means, generally designated 62, for supporting articles. The support means 60 pivotable in the horizontal plane comprises a fixture plate 64 secured to an upper corner of the inner surface of the cabinet rear wall 20 and defining a plurality of vertically extending pockets 66. For each pocket 66 there is a right angle member 68 having a vertically extending arm 70 pivotably received in the pocket 66 and a horizontally extending arm 62 for the support of articles of clothing and the like. The pockets 66 are so disposed on the plate 64 in staggered vertical and horizontal relationship that each of the horizontally extending arms 72 of the members 68 may be swung in a horizontal plane from its inoperative or storage position parallel to cabinet rear wall 20 outwardly by generally about ninety degrees to an operative or supporting position extending over the upper surface 42 of the drop board 30 in its dropped position. If desired, arms 72 may be telescopic so that the rods 72 can be extended out over the dropped drop board 30 a distance greater than the width of the cabinet 16. Furthermore, if desired, a similar horizontally pivotable support means 60 may be disposed in the other corner of cabinet 60.

The support mean 62 pivotable in the vertical plane comprises a vertical pivot 80 secured to a central region of the inner surface of cabinet rear wall 20 and a plate 82 mounted on the pivot for movement between an inoperative or storage position parallel to cabinet rear wall 20 and an operative or supporting position perpendicular thereto (the former being shown in FIGS. 2 and 4 and in phantom line in FIG. 3 and the latter being shown in FIG. 3). The plate 82 supports an extension plate 84 for movement therewith, the extension plate 84 in turn supporting the lower end of a telescoping rod 86. The telescopic rod 86 is pivotably mounted adjacent the lower end thereof on the extension plate 84 by a pivot pin 88, the ability of the telescopic rod 86 to pivot outwardly in a vertical plane and thus extend outwardly over more of upper surface 42 of drop board 30 being limited by a stop 90 on the extension plate 84. At the upper end of the telescopic rod 86 is a horizontally extending mounting member 92 and a semicylindrical rotatable locking disk 94. A support arm 96 is mounted on each end of mounting member 92 by means of a pivot pin 98 permitting movement of the support arm 96 between an inoperative or storage position in which it extends generally vertically, as shown in FIGS. 2, 4 and 10, and an operative or supporting position in which it extends generally horizontally outstretched, as shown in FIG. 3 and in phantom line in FIG. 10. The locking disk 94 is rotatable about telescopic rod 86 relative to the mounting member 92 between an enabling position, wherein relative movement of the support arms 96 about pivot pins 98 between the supporting and storage positions is permitted so that the support arms 96 normally assume the vertical or inoperative position under the influence of gravity, and a locking position wherein the locking disk 94 prevents upward rotation of the adjacent ends of the locking arms 96 so that the support arms 96 are maintained in the supporting horizontal position. While the entire support means 62 is compactly stored within the cabinet 16, it is easily moved into an operative supporting position simply by horizontally swinging out the plate 82 and the extension plate 84 so that the latter extends over the drop board 30 in its dropped position, then swinging the telescopic rod 86 out over the drop board 30 and extending the same upwardly and outwardly, and finally moving the support arms 96 in the vertical plane to their horizontal supporting position and locking them there by rotation of locking member 94.

Clearly other support means 60 and 62 may be utilized which ar capable of being maintained in a compact orientation within the cabinet 16 and yet extended outwardly therefrom and over the upper surface 42 of the drop board 30 (in its dropped position) when desired. Indeed, the cabinet 16 may be devoid of any support means, with reliance being placed upon external support means to maintain the objects in appropriate disposition over the upper surface 42 of the drop board 30 when desired.

Disposed below the drop board 30 and also forming a portion or extension of cabinet front wall 18 is a control panel generally designated 110. As best seen in FIGS. 2, 4 and 12, the rectangular control panel is mounted by various screws to the lower portion of the cabinet 16. Two screws 112 pass unthreaded through apertures 114 (see FIG. 12) adjacent the bottom of the control panel 110 and engage the threaded apertures 116 of lugs 118 upstanding from a rearwardly extending flange 120 of the cabinet front wall 18, and two screws 122 pass through unthreaded apertures 124 (see FIG. 2) adjacent the sides of the control panel 110 and engage the threaded apertures 126 of lugs 128 extending inwardly from the inner surfaces of cabinet vertical sidewalls 22.

Referring now to FIGS. 1, 2, 4 and 7, a heater/-blower 130 is mounted on the inner surface of the control panel 110 by screws 132. The control panel 110 further includes, accessible from the outside of the drying center, high/low fan control means 134, high/low heat control means 136, and a 60 minute timer 138, all for controlling operation of the hot air blower 130. Energization of the hot air blower 130 is effected by a plug 140 which extends through an aperture 142 in the cabinet back wall 20 into an electrical wall socket 144 disposed on the rear wall of recess 12 in wall 14. As almost of the working elements of the drying center are disposed on the control panel 110, and the control panel 110 is secured to the cabinet 16 only by four screws 112, 122, removal of the control panel 110 and most of the working elements from the cabinet 16 for cleaning or repair is facilitated.

Referring now to FIGS. 2–6, a horizontally extending flange member 150 is welded at its ends to opposed inner surfaces of the cabinet vertical sidewalls 22, has one arm vertically directed and fixed to the cabinet rear wall 20, and the other arm directed forwardly and resiliently bearing on the inner surface 42 of the drop board 30 as the drop board moves between its raised and dropped positions.

A horizontally extending curved member generally designated 152 is welded at its ends to opposed inner surfaces of the cabinet vertical sidewalls 22 just below the bottom end of the drop board 30 when drop board 30 is in its raised position. The curved member 152 includes an upper curved portion 153 which is resiliently flexible so that the free end thereof 154 maintains contact with the drop board 30 as the latter moves between its raised and dropped positions. The curved member 152 includes a lower vertically extending portion 155 which is flush with and forms a portion or extension of the cabinet front wall 18 between the bottom of the drop board 30 (when the drop board is in the raised position) and the top of the control panel 110.

The drop board 30 is hollow substantially throughout and defines a plenum 160 therewithin at least coextensive with the matrix of small apertures 143. At the lower end of the drop board 30, the inner surface 42 defines an arcuate segment 162 facing the rear wall 20 when the board 30 is in the raised position (shown in FIG. 5). The base or end of the board 30 facing the rear wall 50 when the drop board is in the dropped position defines an aperture 164 communicating with plenum 160, the plenum aperture 164 being blocked by the curved portion 153 of the curved member 152 when the board 30 is in the raised position (shown in FIG. 5).

Figure 5:
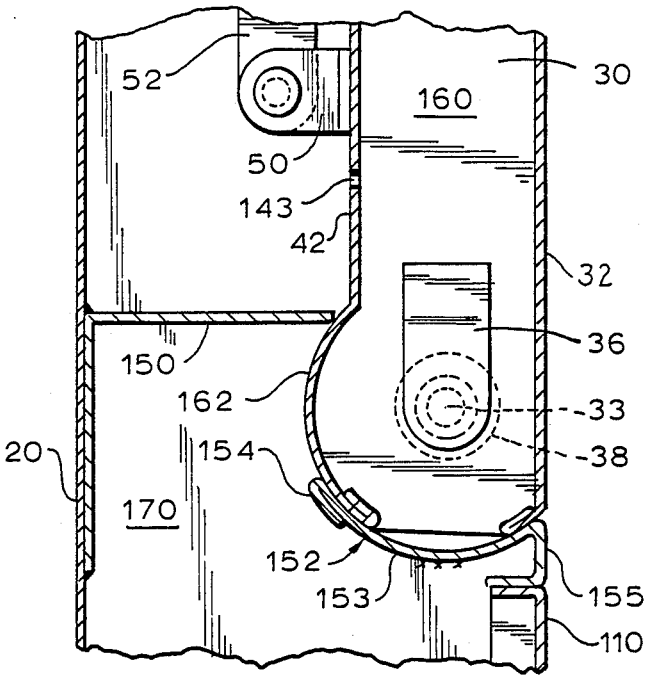
FIG. 5 is a fragmentary side elevation view of the drying center, partially in cross-section, to a greatly enlarged scale, showing the drop board in the raised orientation.

Thus, when the drop board 30 is in its raised position, there is a chamber 170 defined at the bottom by the cabinet bottom sidewall 22, at the rear by the cabinet rear wall 20 (with the plug 140 blocking the aperture 142 in the rear wall 20), at the top by the combination of the horizontal arm of the flanged member 150, the downwardly extending arcuate segment 162 of the base of the drop board 30 against which the horizontal arm of flanged member 150 bears, and the curved portion 153 of the curved member 152 (which blocks plenum aperture 164 as shown in FIG. 5), and at the front by the combination of the vertical portion 155 of the curved member 152, the control panel 110, and the bottom of the cabinet front wall 18. The chamber 172 is substantially airtight except for a grill of air intakes 172 disposed in the control panel 110. If the blower 130 is turned on (by timer 138) when the drop board 30 is in the raised position, air drawn through the air intakes 172 enters the chamber 170 and, as the pressure builds within chamber 170, will escape through the intakes 172 which therefore act as a safety valve preventing a dangerous buildup of pressure in chamber 170.

Figure 6:
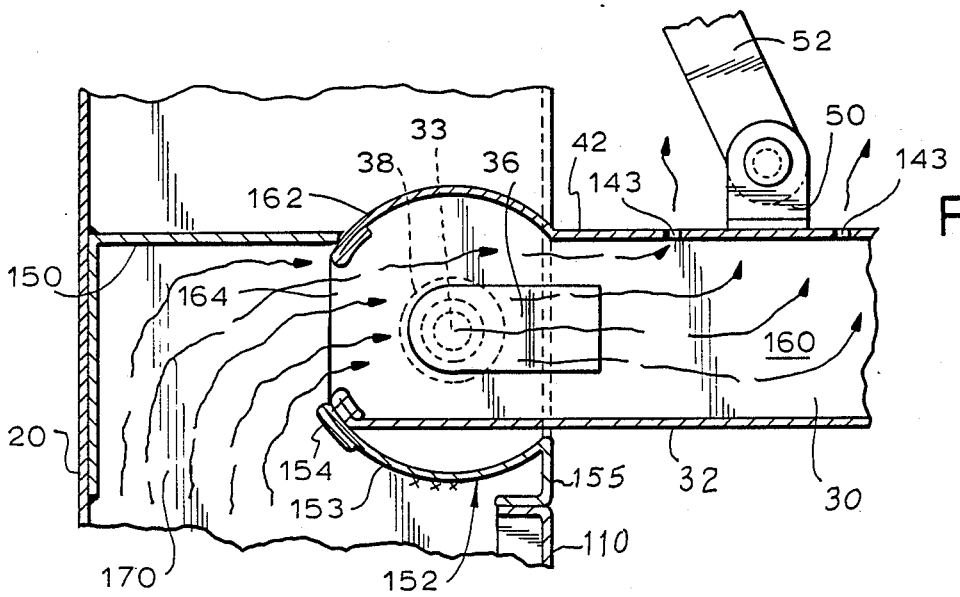
FIG. 6 is a view similar to FIG. 5, but with the drop board in the lowered orientation.
Figure 7:
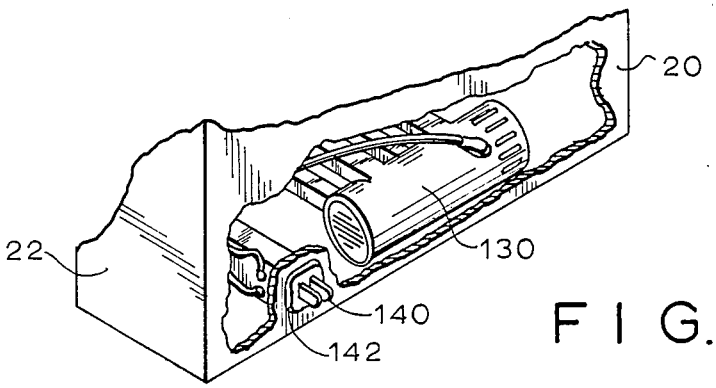
FIG. 7 is a fragmentary isometric view of the rear of the drying center, with portions of the rear wall being cut away to illustrate electrical components therein.

On the other hand, when the drop board 30 is in its dropped position, the relocated horizontally extending arcuate segment 162 of the drop board 30 still forms a part of the upper wall of the chamber 170, but the plenum aperture 164 is now exposed (as shown in FIG. 6). Thus air taken in through the air intakes 172 is blown or heated and blown by hot air blower 130 through the chamber 170 and plenum aperture 164 into board plenum 160 and hence out through the matrix of small apertures 143 on the board upper surface 42. The hot air exiting the small apertures 143 rises, both because it is directed upwardly by the apertures 143 and because hot air naturally rises, so that it engages the horizontal arms 72 of support means 60 when the arms 72 are in the supporting or operative position and engages the supporting arms 96 of the support means 62 when the plate 82 and extension plate 84 are in the extended position and the supporting members 96 are in the operative or supporting position (whether or not telescoping rod 86 is extended) Clothing or other articles to be dried on the support arms 72 or 96 are therefore positioned over the hot air flow escaping from the apertures, the height of the clothing on arms 96 over the apertures being determinable by the degree of telescoping of telescopic rod 86

Figure 13:
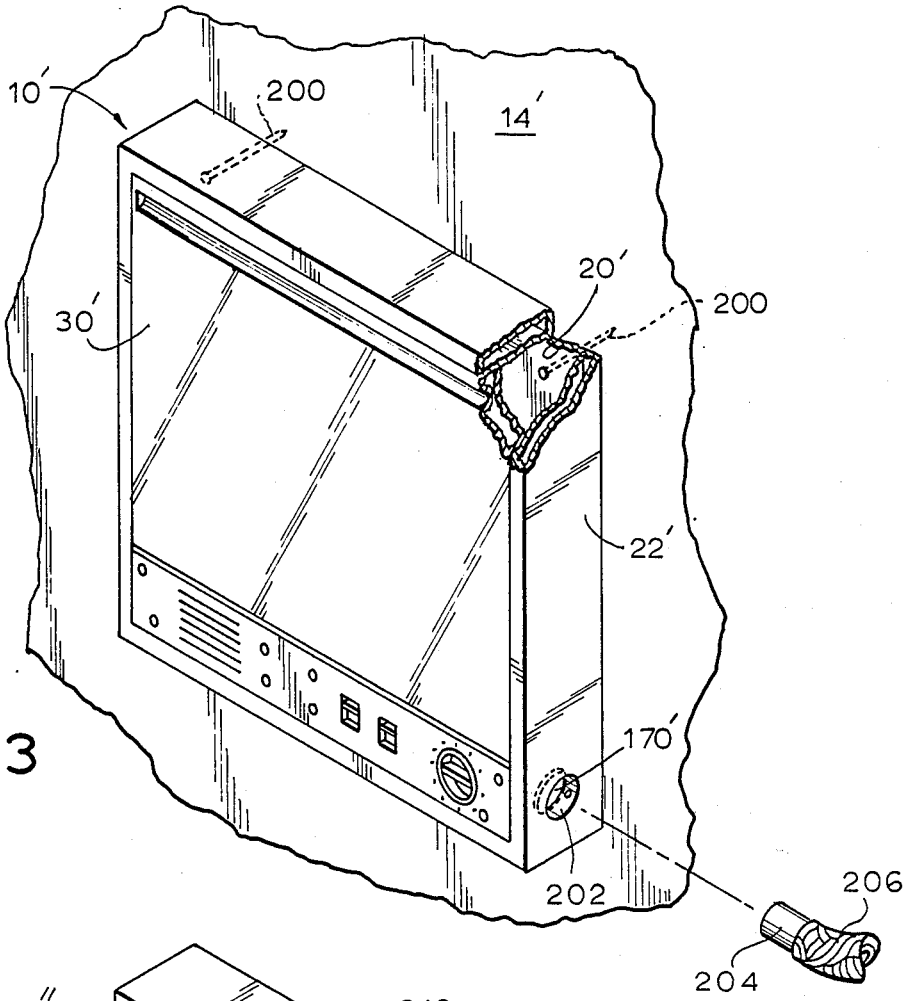
FIG. 13 is a isometric view of a second embodiment of the drying center mounted on a fragmentary wall so as to project therefrom, with portions of the drying center being cut away to reveal details of the internal construction and mounting, and with an external device being indicated fragmentarily for insertion into the drying center.

Referring now to FIG. 13, therein illustrated is another wall-mounted embodiment 10' of the present invention. Elements of this and the third embodiments of the present invention performing identical or similar functions to elements of the first embodiment have been designated with the corresponding reference numeral primed or double primed. In this second embodiment the drying center 10' is not flush mounted in wall 14', but rather mounted on the face thereof, for example by nails 200 passing through the cabinet rear wall 20' into wall 14' or by screws, adhesives or other fastening means.

In the second embodiment 10', a vertical sidewall 22' is provided with a self-sealing port 202 which is in gaseous communication with the internal chamber 170' and adapted to receive the input nozzle 204 of an external drying device 206, such as an air driven hot air drying cap for people to use after showering or shampooing to dry their hair. Such caps have no internal moving parts and are therefore relatively inexpensive; thus they may be provided as removable amenities by a hotel. In order to utilize the external drying device 206, its nozzle 204 is inserted into the port 202, and the drying center 10' is employed with the drop board 30' in the raised position. It will be appreciated that, with the drop board 30' in its raised position, air in chamber 170' cannot enter the plenum aperture and escape through board apertures and thus is delivered undiminished to port 202. While the external drying device 206 may also be employed with the drop board 30' in its dropped position, the hot air blower may not be adequate to provide a sufficient stream of heated air for both functions, both to nozzle 204 and the small apertures of drop board 30'.

Figure 14:
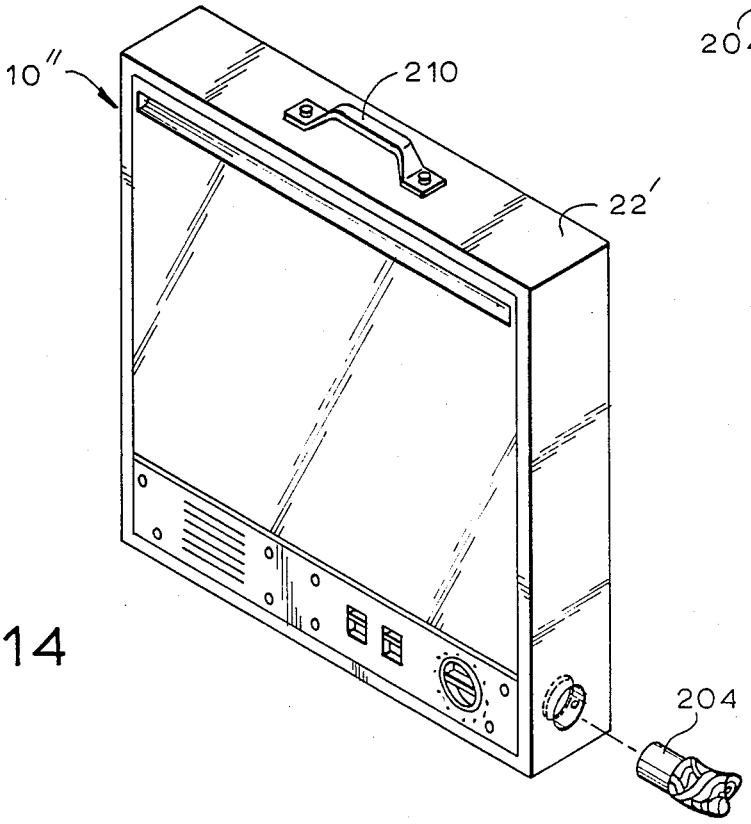
FIG. 14 is an isometric view of a portable third embodiment of the drying center, with an external device being indicated fragmentarily for insertion into the drying center.

Referring now to FIG. 14, therein illustrated is a portable embodiment 10″ of the present invention. The drying center 10″ is identical to the embodiment 10′ except that there are no fasteners 200 and a handle 210 is mounted on the cabinet top sidewall 22″ to facilitate carrying of the drying center.

It will be appreciated that the port 202 enabling use of an external drying device 204 may be employed as well in connection with the first embodiment 10 of the present invention—for example, by locating the port 202 in the control panel 110.

Each embodiment of the present invention may be varied in order to meet the needs of particular applications. For example, while the drying center as described hereinabove is adapted for use with a dry air source (that is, blower 130) as part thereof within cabinet 16, clearly a single centralized air source or blower could be used for a plurality of guest rooms in a hotel, each room containing a drying center, along the lines of centralized heating or air conditioning. The drying center may also be used as a pressing center simply by substituting a steam source (that is, a source of hot moist air) for the source of dry air or heated dry air. While in the illustrated embodiments means ar provided for selectively operatively connecting and disconnecting the air source 130 and the plenum 160, in those instances where there would be no port 202 for receiving an external drying device 204, the connecting means may permanently connect the air source 130 and plenum 160— for example, by doing away with the curved portion 153 of curved member 152 or placing apertures therethrough.

To summarize, the present invention provides a drying device which is capable of providing a prolonged stream of dry hot air of a substantial cross section (determined by the capacity of the hot air blower and the extent of the matrix of apertures). The device has a compact orientation when not in use, yet includes means for supporting the articles to be dried in the dry air stream. Particular embodiments can be used to dry clothing or, in conjunction with an external air driven device, to dry hair. The device is of hardy, rugged and economical construction, easy and economical to use and maintain.

Now that the preferred embodiments of the present invention have been shown and described in detail, various modifications and improvements thereon will become readily apparent to those skilled in the art. Accordingly, the spirit and scope of the present invention are to be limited only by the appended claims, and not by the foregoing specification.

I claim:

1. A drying center comprising:

(A) a housing;

(B) means defining a plenum and having a surface defining a plurality of spaced apertures in gaseous communication with said plenum;

(C) means mounting said plenum means on said housing for movement relative to said housing between an operative position wherein at least some of said plurality of spaced apertures are substantially spaced from said housing and a storage position wherein said plenum means acts as a closure for said housing;

(D) an air source for blowing air; and (E) means for operatively connecting said air source and said plenum means; said connecting means operatively connecting said air source and said plenum means by putting the same in fluid communication when said plenum means is in said operative position and disconnecting the same by interrupting the fluid communication when said plenum means is in said storage position.

2. The drying center of claim 1 wherein said plenum means is substantially coextensive with said plurality of apertures.

3. The drying center of claim 1 wherein said air source is a source of dry air.

4. The drying center of claim 3 wherein said air source is a source of heated dry air.

5. The drying center of claim 1 additionally comprising a normally closed port in gaseous communication with said air source, said port being adapted to provide gaseous communication between said air source and an air-driven external drying device.

6. The drying center of claim 1 additionally comprising support means normally disposed within said housing for supporting objects to be dried over said plurality of apertures when said plenum means is in said operative position.

7. The drying center of claim 6 wherein said support means is movable between a withdrawn position totally within said housing and an extended position extending at least partially out of said housing.

8. The drying center of claim 1 wherein said plenum means is pivotally mounted at one end in said housing.

9. The drying center of claim 8 additionally comprising means limiting movement of said plenum means from said storage position beyond said operative position.

10. The drying center of claim 1 wherein said plenum means in said operative position is substantially horizontal and in said storage position is substantially vertical.

11. The drying center of claim 1 wherein said surface of said plenum means defining a plurality of spaced apertures is an upper surface thereof when said plenum means is in said operative position.

12. The drying center of claim 11 wherein said connecting means operatively connects said air source and said plenum when said plenum means is in said operative position and disconnects the same when said plenum means is in said storage position.

13. The drying center of claim 1 wherein said housing has a front wall, a rear wall and a sidewall, said plenum means in said storage position comprising at least a portion of said front wall.

14. The drying center of claim 13 in combination with a room having a wall, said housing being flush mounted on said wall with said wall of said room and said front wall of said housing being flush.

15. The drying center of claim 1 additionally including means secured to said housing for carrying said drying center.

16. A drying center comprising:

(A) a cabinet;

(B) a drop board secured to said cabinet and movable between a dropped position wherein said board is substantially horizontal and a raised position wherein said board is substantially vertical, said drop board defining a plenum and in said dropped position having an upper surface defining a plurality of spaced apertures in gaseous communication with said plenum;

(C) an air source for blowing air; and (D) means for operatively connecting said air source and said plenum; said connecting means operatively connecting said air source and said plenum by putting the same in fluid communication when said drop board is in said dropped position and disconnecting the same by interrupting the fluid communication when said drop board is in said raised position.

17. The drying center of claim 16 wherein said plenum is substantially coextensive with said plurality of apertures.

18. The drying center of claim 16 wherein said air source is a source of heated dry air.

19. The drying center of claim 16 additionally comprising a normally closed port in gaseous communication with said air source, said port being adapted to provide gaseous communication between said air source and an air driven external drying device.

20. The drying center of claim 16 additionally comprising support means normally disposed within said cabinet for supporting objects to be dried over said apertures when said board is in said dropped position.

21. The drying center of claim 20 wherein said support means is movable between a withdrawn position totally within said cabinet and an extended position extending at least partially out of said cabinet.

22. The drying center of claim 16 wherein said drop board is pivotally mounted at one end in said cabinet.

23. The drying center of claim 22 additionally comprising means limiting movement of said drop board from said raised position beyond said dropped position.

24. The drying center of 23 wherein said connecting means operatively connects said air source and said plenum when said drop board is in said dropped position and disconnects the same when said drop board is in said raised position.

25. The drying center of claim 16 wherein said cabinet has a front wall, a rear wall and a sidewall, said drop board in said raised position comprising at least a portion of said front wall.

26. The drying center of claim 25 in combination with a room having a wall, said cabinet being flush mounted on said wall with said wall of said room and said front wall of said cabinet being flush.

27. The drying center of claim 16 additionally including means secured to said cabinet for carrying said drying center.

28. A drying center comprising:

(A) a cabinet having a front wall, a rear wall and a sidewall;

(B) a drop board pivotally secured to said cabinet and movable between a dropped position wherein said board is substantially horizontal and a raised position wherein said board is substantially vertical, said drop board defining a plenum and in said dropped position having an upper surface defining a plurality of spaced apertures in gaseous communication with said plenum, said plenum being substantially coextensive with said plurality of apertures, said drop board being pivotally mounted at one end in said cabinet and in said raised position comprising at least a portion of said front wall;

(C) an air source for blowing heated dry air;

(D) means for selectively operatively connecting and disconnecting said air source and said plenum, said connecting means operatively connects said air source and said plenum when said drop board is in said dropped position and disconnecting the same when said drop board is in said raised position; and (E) support means normally disposed within said cabinet for supporting objects to be dried over said apertures when said board is in said dropped position, said support means being movable between a withdrawn position totally within said cabinet and an extended position extending at least partially out of said cabinet.

29. The drying center of claim 11 wherein said surface of said plenum means defining a plurality of spaced apertures is a vertical surface thereof when said plenum means is in said storage position.

30. The drying center of claim 1 wherein, when said plenum means is in said operative position, said at least some apertures are generally upwardly directed and, when said plenum means is in said storage position, said at least some apertures are generally horizontally directed.

31. The drying center of claim 1 wherein said plenum means does not act as a closure for said housing when said plenum means is in said operatively position.

32. The drying center of claim 1 wherein said spaced apertures are not substantially spaced from said housing when said plenum means is in said storage position.

33. A drying center comprising:

(A) A cabinet having a front wall, a rear wall and a sidewall;

(B) a drop board pivotally secured to said cabinet and movable between a dropped position wherein said board is substantially horizontal and a raised position wherein said board is substantially vertical, said drop board defining a plenum and in said dropped position having an upper surface defining a plurality of spaced apertures in gaseous communication with said plenum, said plenum being substantially coextensive with said plurality of apertures, said drop board being pivotally mounted at one end in said cabinet and in said raised position comprising at least a portion of said front wall;

(C) an air source for blowing heated dry air;

(D) means for selectively operatively connecting and disconnecting said air source and said plenum, said connecting means operatively connects said air source and said plenum when said drop board is in said dropped position and disconnecting the same when said drop board is in said raised position; and (E) support means normally disposed within said cabinet for supporting objects to be dried over said apertures when said board is in said dropped position, said support means being movable between a withdrawn position totally within said cabinet and an extended position extending at least partially out of said cabinet.

34. The drying center of claim 1 wherein said air source is disposed within said housing and spaced from said plenum means to enable movement of said plenum means between said operative position and said storage position without movement of said air source.

35. The drying center of claim 34 wherein said housing is stationary.

36. The drying center of claim 16 wherein said air source is disposed within said cabinet and spaced from said drop board to enable movement of said drop board between said dropped position and said raised position without movement of said air source.

37. The drying center of claim 36 wherein said cabinet is stationary.

38. The drying center of claim 28 wherein said air source is disposed in said cabinet and spaced from said drop board to enable movement of said drop board between said dropped position and raised position without movement of said air source.

39. The drying center of claim 38 wherein said cabinet is stationary.

40. The drying center of claim 33 wherein said air source is disposed in said cabinet and spaced from said drop board, to enable movement of said drop board between said dropped position and said raised position without movement of said air source.

41. The drying center of claim 40 wherein said cabinet is stationary.

* * * * *